US008777763B2

(12) United States Patent
Genser

(10) Patent No.: US 8,777,763 B2
(45) Date of Patent: Jul. 15, 2014

(54) ARTIFICIAL SURFACE SUITABLE FOR MAKING HORSE TRACKS

(71) Applicant: NARRS, Inc., Palm Beach, FL (US)

(72) Inventor: Franck Genser, Paris (FR)

(73) Assignee: NAARS, Inc., Palm Beach, FL (US)

( * ) Notice: Subject to any disclaimer, the term of this patent is extended or adjusted under 35 U.S.C. 154(b) by 21 days.

(21) Appl. No.: 13/628,928

(22) Filed: Sep. 27, 2012

(65) Prior Publication Data

US 2014/0073442 A1 Mar. 13, 2014

(30) Foreign Application Priority Data

Sep. 10, 2012 (FR) ..... 12/58462

(51) Int. Cl.
*A63K 1/02* (2006.01)
*E01C 13/08* (2006.01)

(52) U.S. Cl.
USPC ..... 472/86; 472/92

(58) Field of Classification Search
USPC ..... 472/85–90, 92, 136, 137
See application file for complete search history.

(56) References Cited

U.S. PATENT DOCUMENTS

| | | | | | |
|---|---|---|---|---|---|
| 611,876 | A * | 10/1898 | Walsh | 472/87 |
| 4,852,870 | A * | 8/1989 | Hawkins et al. | 472/86 |
| 4,968,024 | A * | 11/1990 | Hawkins | 472/86 |
| 6,821,332 | B2 * | 11/2004 | Hubbs | 106/272 |
| 7,104,894 | B2 * | 9/2006 | Bennett | 472/86 |

* cited by examiner

*Primary Examiner* — Kien Nguyen
(74) *Attorney, Agent, or Firm* — Faegre Baker Daniels LLP

(57) ABSTRACT

An artificial surface suitable for making horse tracks includes fine siliceous sand with median granulometry less than 500 μm and a silica content higher than 60 % wt., and a proportion by weight ranging from 3 to 5% of very fine hollow synthetic fibers of polyester or polypropylene.

11 Claims, No Drawings

ARTIFICIAL SURFACE SUITABLE FOR MAKING HORSE TRACKS

CROSS-REFERENCE TO RELATED APPLICATION

This application claims priority under Title 35, U.S.C. §119 of French Patent Application No. 12 58 462 filed Sep. 10, 2012, the entire disclosure of which is hereby explicitly incorporated by reference herein.

BACKGROUND OF THE INVENTION

1. Field of the Invention

The present invention relates to an artificial surface suitable for making horse tracks.

2. Description of the Related Art

The surface classically used for races and horse shows is grass, which has the disadvantage of being sensitive to freezing and giving rise to a fast wear and tear in the event of heavy use.

For that reason, grass is reserved for tracks that are used only at the summer months or grounds that have a sufficiently large area to enable it to regenerate itself.

When these conditions were not met, we had the idea to generally replace grass with artificial surfaces most often based on fine siliceous sand, if necessary combined with materials such as wood fibers, ashes from thermal power plants or crushed synthetic materials such as polyvinyl chloride.

The surfaces thereby manufactured did not prove to be satisfactory, considering that they degrade as they age and especially that they lack cohesion and do not hold.

When we researched making such artificial surfaces, we initially primarily endeavored to try to obtain layers that were sufficiently load-bearing layers.

Yet, it is known that bearing capacity is an exponential function of the angle of friction in the ground.

Consequently, to increase the bearing capacity, we sought to introduce additional sources of friction into the ground.

The first idea that came to mind for the specialists consisted of trying to adapt—for making artificial surfaces intended for horse tracks—broken-up angular aggregates such as are usually used in road engineering.

It is indeed easy to conceive that such aggregates can, due to their angular character, wedge themselves geometrically against each other under the action of the circulation of vehicles, thereby causing an increase in the bearing capacity by mechanical effect.

However, it proved that such aggregates cannot be appropriate for an equestrian use considering that they impede the hoof of the horses.

Considering that situation, we thought of using siliceous sands, whose bearing capacity is intrinsically insufficient, and stabilizing them by dispersing full synthetic fibers in them, particularly polypropylene fibers.

Such fibers are likely to increase the cohesion and bearing capacity due to the mechanical friction against the grains of sand thereby generated.

However, incorporating fibers into sand can cause difficulty, with the result that the surfaces thereby manufactured are relatively expensive, thereby limiting the use of this technique.

In addition and primarily, incorporating full synthetic fibers into siliceous sand does not yield artificial surfaces suitable for making horse tracks that have satisfactory characteristics from the standpoint of resiliency and flexibility.

To remedy that disadvantage, it has already been proposed to mix additives such as cork or foam into the mixture of sand and fibers, but it was not thereby possible to obtain results that were satisfactory in all respects insofar as the presence of such additives modifies the behavior of the fibers.

Moreover, such flexibility additives are expensive and therefore appreciably increase the cost of the artificial surfaces thereby designed.

SUMMARY OF THE INVENTION

The present invention aims to remedy the above-mentioned disadvantages by proposing an artificial surface suitable for making horse tracks that has characteristics of bearing capacity, resiliency and flexibility that are broadly satisfactory and whose implementation does not concurrently cause excessive expenses, thereby allowing a very broad use.

In one form thereof, the present invention provides an artificial surface suitable for making horse tracks, characterized in that it consists of fine siliceous sand with median granulometry lower than 500 μm and has a silica content higher than 60% into which is incorporated a proportion by weight ranging from 3 to 5% of very fine hollow synthetic fibers particularly made of polyester or polypropylene.

DETAILED DESCRIPTION

For this purpose, the invention relates to an artificial surface suitable for making horse tracks characterized in that it is composed of fine siliceous sand with median granulometry less than 500 μm and having a silica content higher than 60% wt., into which is incorporated a proportion by weight ranging from 3 to 5% of very fine hollow synthetic fibers, particularly made of polyester or polypropylene.

According to another characteristic of the invention, the hollow synthetic fibers have a length ranging from 15 to 35 mm.

According to another characteristic of the invention, the hollow synthetic fibers have a thread count ranging from 5 to 20 decitex.

Indeed we realized in accordance with the invention that, surprisingly, replacing full synthetic fibers with hollow synthetic fibers of this type enables us to remedy the above-mentioned disadvantages, and to increase the cushioning by approximately 30% particularly.

In accordance with the invention, we can advantageously implement hollow synthetic fibers comprising a siliconized coating particularly of the type like those usually used for manufacturing synthetic pillows.

The presence of such a coating has the advantage of making it easier to implement the fibers.

However, after a certain usage period, that coating disappears due to friction and degradation, and therefore does not share the intrinsic properties of the artificial surface pursuant to the invention.

According to another characteristic of the invention, the artificial surface has a thickness ranging from 80 to 200 mm.

It is applied directly to a bearing foundation, whose slope is between 0.5 and 2.5%.

The foundation can have drainage or not.

Here again, this is a particularly advantageous characteristic of the invention insofar as it makes it possible to make a very significant drainage savings.

The invention claimed is:

1. An artificial surface for use as a horse track, comprising fine siliceous sand having a median granulometry lower than 500 μm and a silica content higher than 60% wt. into which is incorporated a proportion by weight ranging from 3 to 5% of very fine hollow synthetic fibers of polyester or polypropylene.

2. The artificial surface of claim 1, wherein the hollow synthetic fibers have a length ranging from 15 to 35 mm.

3. The artificial surface of claim 2, wherein the hollow synthetic fibers have a thread count ranging from 5 to 20 decitex.

4. The artificial surface of claim 2, wherein the hollow synthetic fibers have a silicone coating.

5. The artificial surface of claim 2, wherein the artificial surface has a thickness ranging from 80 to 200 mm.

6. The artificial surface of claim 1, wherein the hollow synthetic fibers have a thread count ranging from 5 to 20 decitex.

7. The artificial surface of claim 6, wherein the hollow synthetic fibers have a silicone coating.

8. The artificial surface of claim 6, wherein the artificial surface has a thickness ranging from 80 to 200 mm.

9. The artificial surface of claim 1, wherein the hollow synthetic fibers have a silicone coating.

10. The artificial surface of claim 9, wherein the artificial surface has a thickness ranging from 80 to 200 mm.

11. The artificial surface of claim 1, wherein the artificial surface has a thickness ranging from 80 to 200 mm.

* * * * *